US006289983B1

(12) United States Patent
Pustelnik

(10) Patent No.: US 6,289,983 B1
(45) Date of Patent: Sep. 18, 2001

(54) ARRANGEMENT FOR CONNECTING A CONDUIT TO A LIQUID DISTRIBUTOR

(76) Inventor: Werner Pustelnik, Hutweidengasse 30, A-1190 Vienna (AT)

( * ) Notice: Subject to any disclaimer, the term of this patent is extended or adjusted under 35 U.S.C. 154(b) by 0 days.

(21) Appl. No.: 09/403,080

(22) PCT Filed: Dec. 16, 1998

(86) PCT No.: PCT/AT98/00309

§ 371 Date: Oct. 13, 1999

§ 102(e) Date: Oct. 13, 1999

(87) PCT Pub. No.: WO99/44005

PCT Pub. Date: Sep. 2, 1999

(30) Foreign Application Priority Data

Feb. 24, 1998 (AT) ..... A 330 98

(51) Int. Cl.[7] ..... F28F 9/04

(52) U.S. Cl. ..... 165/178; 165/137; 165/67; 285/12; 285/184

(58) Field of Search ..... 165/173, 178, 165/149, 67, 137, 76; 285/12, 184, 148.27; 137/376, 327

(56) References Cited

U.S. PATENT DOCUMENTS

| | | | | |
|---|---|---|---|---|
| 1,546,858 | * | 7/1925 | Nathanson et al. | 165/178 |
| 2,449,052 | * | 9/1948 | Brown, Jr. | 165/178 |
| 2,639,899 | | 5/1953 | Young | 257/129 |
| 2,709,999 | * | 6/1955 | Nagel | 285/12 |
| 2,872,164 | * | 2/1959 | Wilson | 165/178 |
| 5,178,213 | | 1/1993 | Watson et al. | 165/173 |
| 5,501,271 | * | 3/1996 | Wijkstrom | 165/173 |
| 5,544,714 | * | 8/1996 | May et al. | 165/67 X |
| 5,664,432 | | 9/1997 | O'Brien | 62/298 |

FOREIGN PATENT DOCUMENTS

| | | | | |
|---|---|---|---|---|
| 0450241 | * | 10/1991 | (EP) | 285/184 |
| 2588365 | | 4/1987 | (FR) . | |
| 2049149 | | 12/1980 | (GB) . | |
| 361079816 | * | 4/1986 | (JP) | 165/178 |

* cited by examiner

*Primary Examiner*—Christopher Atkinson
(74) *Attorney, Agent, or Firm*—Karl Hormann

(57) ABSTRACT

Device for connecting tubular conduits with the distributor section or tank (2) of a liquid treatment flow through apparatus (1) provided with treatment elements assembled as a parallelepiped package or core the tank extending over a front surface of the package and provided in a corner section with a cut off triangular section (3) in which there is provided a passage (4) for the liquid, and a substantially pyramidal hollow adapter attachment (6) which may be mounted on the triangular section (3) and which is provided with a base surface having a passage for the liquid corresponding to the passage for the liquid of the triangular section and with a conduit connector opening (9) in one of its side surfaces.

4 Claims, 2 Drawing Sheets

IV
V
1
2
2'
2''
2'''
3
4
5
6
6'
7
8
9

ARRANGEMENT FOR CONNECTING A CONDUIT TO A LIQUID DISTRIBUTOR

BACKGROUND OF THE INVENTION

1. Field of the Invention

The invention relates to an arrangement for connecting tubes to the distributor or manifold section of an apparatus for treating a liquid, particularly an oil/air cooler of the kind usually incorporated in the return path of an oil operating circuit. The cooling elements of the cooler through which the oil is flowing and which are assembled as a parallelepiped package known also as a core usually consist of aluminum plates or staves surrounded by air fins, and are connected to a box-like distributor section or tank extending across the upper surface of the package. Furthermore, the cooling elements are affected by a fan mounted adjacent thereto.

2. The Prior Art

In oil/air coolers of the kind hitherto known, the connector sockets for usually tubular input and output conduits in the distributor or head section of the parallelepiped cooler are of predetermined cross-section and extend at a right angle from the end of the cooler to the outer surface of the distributor section. This requires not only to stock various oil/air cooler models of differently dimensioned connectors, but in many instances it also complicates the installation of an oil/air cooler. Moreover, a relatively large space is needed for connecting the conduits. The mentioned problems also arise in liquid distributors for liquids other than oil, such as, for instance, for the processing of milk and the like.

OBJECT OF THE INVENTION

It is an object of the invention to avoid the mentioned deficiencies and to provide a connector arrangement of the kind referred to above which is suitable for different applications and which for different tubing connectors necessitates stocking of but one model of liquid processing device.

SUMMARY OF THE INVENTION

The invention is embodied in a device for connecting tubular conduits to the distributor or manifold section, also known as a tank of a liquid processing apparatus of the kind provided with a so-called core of aluminum plates or staves assembled as a parallepiped package and with a box-like liquid distributor section or tank extending across a front surface of the package. In accordance with the invention, a corner portion of the parallepiped distributor section is cut off to form a substantially equilateral surface having an opening therein for providing a liquid passage and that a substantially pyramidal hollow adapter attachment is provided which may be placed upon the triangular surface, the adapter attachment being provided with a base provided with a liquid passage corresponding to the liquid passage of the triangular surface and, in one of its side-walls, with a connector opening for a tubular conduit.

The invention makes it possible to mount the adapter attachment at different dispositions or orientations on the flattened portion such that depending upon its intended purpose, the tube connector may be directed to the rear, upwardly or laterally. In accordance with the invention different adapter attachments may be stocked the diameter and thread of the connector opening of which may be matched to given tubular connectors. Thus it is possible in an economically advantageous manner to manufacture and stock but a single model of the liquid processing device.

DESCRIPTION OF THE SEVERAL DRAWINGS

The invention will hereinafter be described in greater detail on the basis of an air/oil cooler and with reference to the drawings, in which:

FIG. 1*a* is a front elevation of the distributor or head section of a partially shown oil/air cooler in accordance with the invention;

FIG. 1*b* is a side elevation of the device shown in FIG. 1*a*;

Figures 6A, 6B:
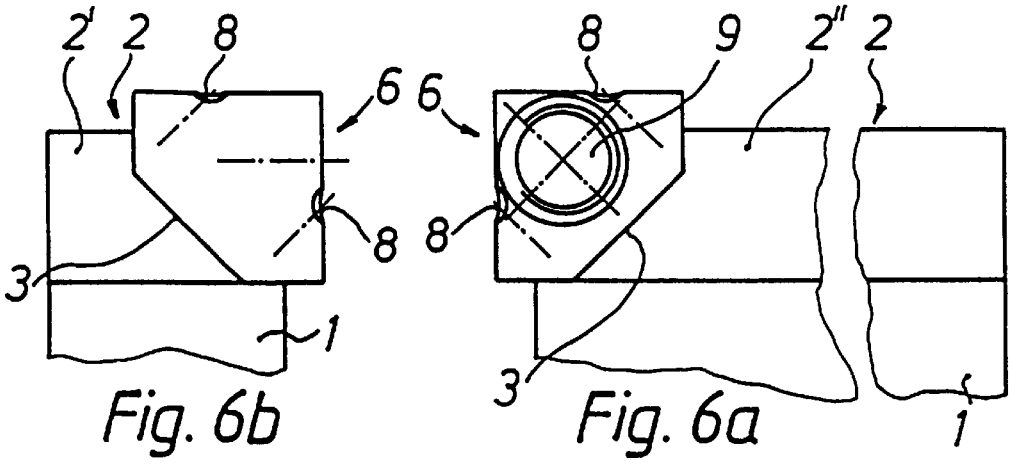

FIGS. 6*a*, 6*b*; 7*a*, 7*b* and 8*a*, 8*b* depict various possible connections.

DESCRIPTION OF THE PREFERRED EMBODIMENTS

As shown in FIG. 1, an oil/air cooler which as a rule consists of a parallelepiped package or core schematically indicated of spaced aluminum plates usually provided with air fins may be provided with a distributor or tank 2 serving to connect input and output conduits to the cooler and functioning as an oil distributor. The package 1 may be provided or associated with a fan (not shown).

The distributor or tank 2 which is of parallelepiped or box-like configuration as well. One of its corners provided with a flat cut-away portion 3. The margins of the preferably equilaterally triangular portion 3 are respectively formed by the front surface 2', the longitudinal surface 2" and the upper surface 2" of the distributor 2. The flat portion 3 is provided with an oil flow-through opening 4 of relatively large diameter and, in each of its three corners with threaded bore 5.

Figures 1A, 1B, 2, 3, 4, 5:
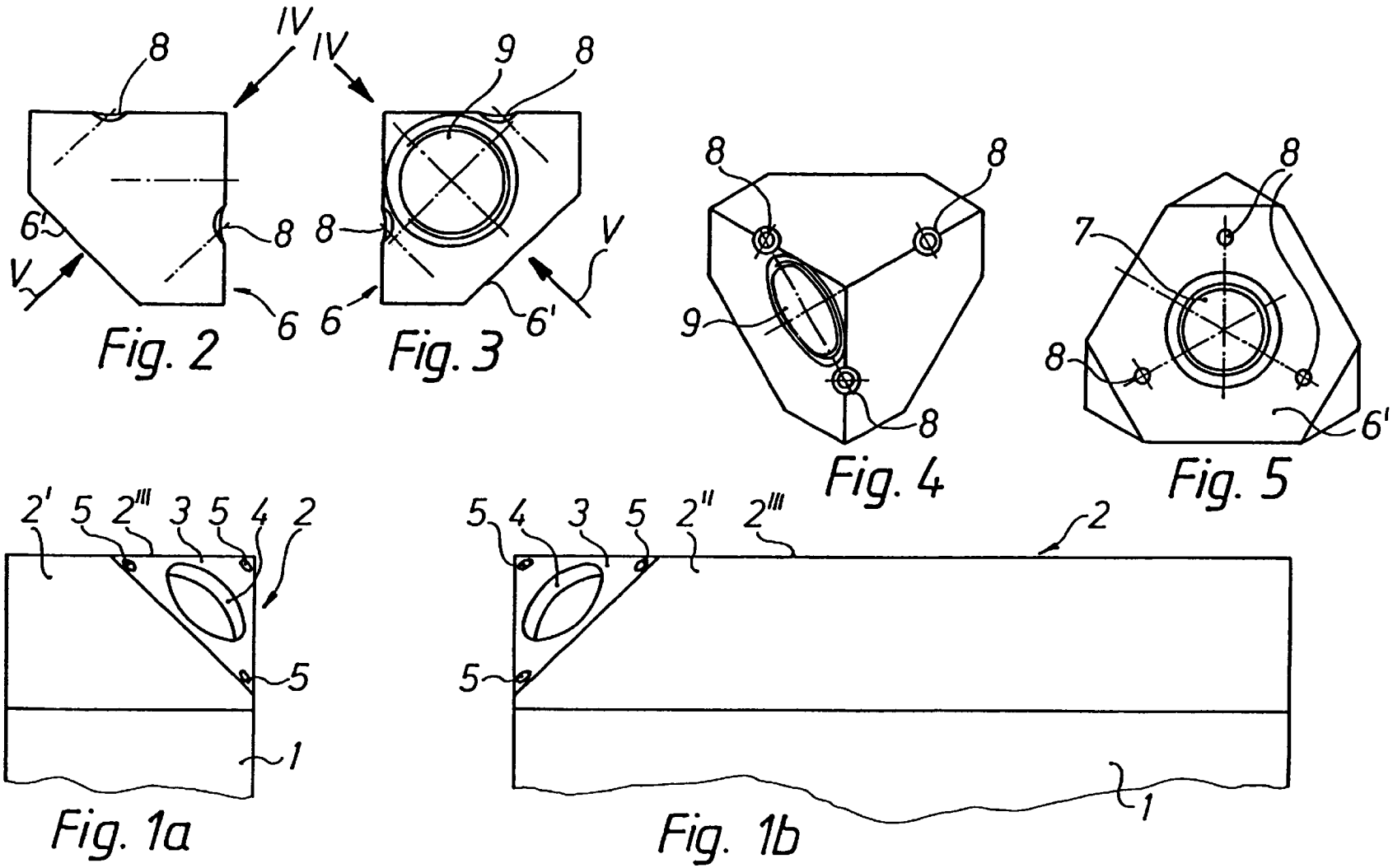
FIG. 2 is a side elevation of the adaptor for the head section.
FIG. 3 depicts the adaptor of FIG. 2 from its other side.
FIG. 4 is a view in the direction of arrow IV' in FIG. 2.
FIG. 5 is a view in the direction of arrow V in FIG. 2.

A substantially three-sided pyramidal hollow adapter attachment 6 shown in side elevation in FIG. 2, may be attached to the triangular portion 3. The adapter attachment 6 has a base surface 6' to be placed on, and slightly extending over, the triangular portion 3. As shown in FIG. 5, the base surface 6' is configured as a triangle with a cut-off corners to form a regular hexagon provided with a center flow-through opening 7 which matches the oil flow-through opening 4 in the flat portion 3.

FIG. 5 also depicts three mounting bores 8 which complement the threaded bores 5 and which as shown in FIG. 4 exit at the three edges of the adapter attachment 6.

As may be seen from FIGS. 3 and 4, the adapter attachment 6 which extends beyond all sides of the distributor section is provided in one of its sidewalls with conduit connector opening 9 of a predetermined diameter and provided with a predetermined thread. The adapter attachment 6 is mounted on the distributor 2 with the connector opening 9 in the desired orientation.

Figures 7A, 7B:
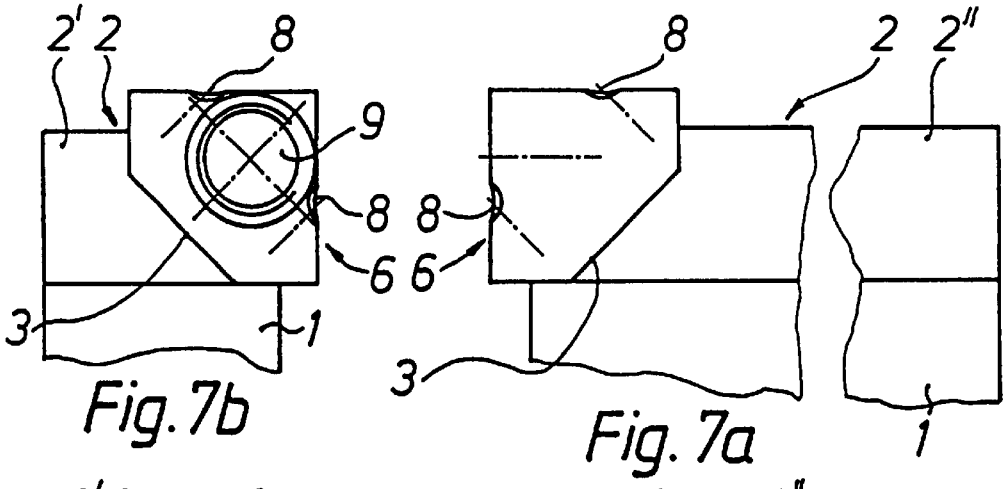
Figures 8A, 8B:
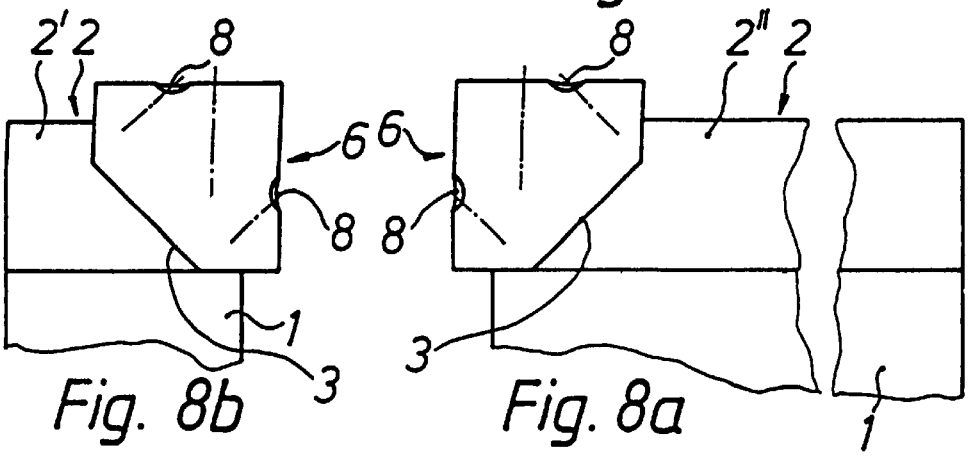

As shown in FIGS. 6 to 8, the connector opening, instead of at the front surface of the oil/air cooler 1 (FIGS. 6*a*, 6*b*), may also be mounted at the rear surface (7*a*, 7*b*) or at the top surface (FIGS. 8*a*, 8*b*) thereof.

It is within the ambit of the invention to stock numerous adaptor attachments 6 with connector openings of different dimensions and different kinds of threads which in a simple manner may be mounted on a complementary type of oil/aid coolers or other liquid treatment apparatus.

What is claimed is:

1. A connection between a substantially parallelepiped tank of a liquid treatment apparatus of the kind provided with a core of flow-through elements connected to the tank, comprising:

a substantially triangular section formed between cut-off adjoining corner sections of three walls of the tank and provided with a first liquid flow-through opening therein; and an adaptor of substantially pyramidal configuration and comprising a substantially triangular base surface having a second liquid flow-through opening therein for alignment with the first flow-through opening and three side surfaces adapted to extend substantially parallel to the three walls, one of the side surfaces forming a third liquid flow-through opening.

2. The connection of claim 1, wherein there is provided a threaded bore in each corner of the triangular section.

3. The connection of claim 2, wherein there is provided a bore in each corner of the base surface matching a threaded bore and extending through a junction of two side surfaces.

4. The connection of claim 3, wherein the triangular section is substantially equilinear and the threaded bores are disposed to form the corner of an equilinear triangle.

* * * * *